US010974741B2

(12) United States Patent
Schneider

(10) Patent No.: US 10,974,741 B2
(45) Date of Patent: Apr. 13, 2021

(54) ACTUATOR FOR CONTROLLING A WHEELSET OF A RAIL VEHICLE

(71) Applicant: Liebherr-Transportation Systems GmbH & Co. KG, Korneuberg (AT)

(72) Inventor: Richard Schneider, Loehningen (CH)

(73) Assignee: Liebherr-Transportation Systems GmbH & Co. KG, Korneuburg (AT)

( * ) Notice: Subject to any disclaimer, the term of this patent is extended or adjusted under 35 U.S.C. 154(b) by 444 days.

(21) Appl. No.: 15/937,751

(22) Filed: Mar. 27, 2018

(65) Prior Publication Data

US 2018/0273057 A1 Sep. 27, 2018

(30) Foreign Application Priority Data

Mar. 27, 2017 (DE) ..... 10 2017 002 926.1

(51) Int. Cl.
*B61F 5/38* (2006.01)

(52) U.S. Cl.
CPC ..... *B61F 5/386* (2013.01)

(58) Field of Classification Search
CPC ..... B61F 5/38; B61F 5/383; B61F 5/386
See application file for complete search history.

(56) References Cited

U.S. PATENT DOCUMENTS 4,640,198 A * 2/1987 Haupl ..... B61F 5/386 105/168
5,429,056 A * 7/1995 Pees ..... B61F 5/325 105/168
5,909,711 A * 6/1999 Vogel ..... B61F 5/38 105/168
6,752,087 B1 * 6/2004 Taylor ..... B61F 3/16 105/165
2010/0326317 A1 * 12/2010 Simson ..... B61F 5/386 105/168
2013/0032054 A1 * 2/2013 Schneider ..... B61F 5/245 105/199.1
2018/0273057 A1 * 9/2018 Schneider ..... B61F 5/386
2020/0130712 A1 * 4/2020 Becher ..... B61F 5/30

FOREIGN PATENT DOCUMENTS

| | | | |
|---|---|---|---|
| AT | 11477 | U1 | 11/2010 |
| DE | 69508888 | T2 | 9/1999 |
| DE | 102004044962 | A1 | 4/2006 |
| EP | 0713818 | A1 | 5/1996 |
| EP | 2039582 | A2 | 3/2009 |
| RU | 2551869 | C1 | 5/2015 |

* cited by examiner

*Primary Examiner* — Jason C Smith
(74) *Attorney, Agent, or Firm* — McCoy Russell LLP

(57) ABSTRACT

The present disclosure relates to an actuator for controlling a wheelset of a rail vehicle comprising: an axle casing for fastening to an undercarriage or to a wheelset bearing housing of the rail vehicle; a synchronized cylinder that is provided in the axle casing and that comprises a piston surface that has a piston rod passing through the axle casing at each of its two areal sides; and a housing that is movable in accordance with a movement of the synchronized cylinder with respect to the axle casing, wherein a piston spring element that connects a respective piston rod to the housing is arranged at the end of the respective piston rod remote from the piston surface.

19 Claims, 5 Drawing Sheets

ACTUATOR FOR CONTROLLING A WHEELSET OF A RAIL VEHICLE

CROSS REFERENCE TO RELATED APPLICATIONS

The present application claims priority to German Patent Application No. 10 2017 002 926.1, entitled "Actuator for Controlling a Wheelset of a Rail Vehicle," and filed on Mar. 27, 2017. The contents of the above-listed application is hereby incorporated by reference in its entirety for all purposes.

TECHNICAL FIELD

The present disclosure relates to an actuator for controlling a wheelset of a rail vehicle, to an undercarriage of a rail vehicle having such an actuator, and to a method of operating the actuator.

BACKGROUND AND SUMMARY

Rail vehicles often pivot the wheels of a wheelset, that are typically rigidly coupled via a shaft, with respect to the undercarriage of a rail vehicle during cornering. So-called wheelset guide elements that consist of rubber metal elements as a rule are provided for this purpose in conventional rail vehicles.

FIG. 1 and FIG. 2 show the different positions of an actuator for controlling a wheelset of a rail vehicle when moving straight ahead and when cornering for a better understanding of the present subject matter.

It is of advantage for the straight ahead movement shown in FIG. 1 for the actuator to rigidly couple the wheelset to the undercarriage frame. In contrast to this, during cornering the actuator pivots the wheelset with respect to the undercarriage frame to ensure a traveling on the tracks that is as low in wear as possible.

Conventional actuators have a restricted stroke that is not sufficient for a satisfactory pivoting of a wheelset. Such actuators furthermore have high longitudinal stiffness values that have the consequence of high control forces. The coupling of longitudinal and transverse stiffness of conventional actuators also reduces the flexibility of the replication of specific undercarriage properties. The risk of a leak also increases in actuators provided with hydraulic lines. In addition, the force of such an actuator is typically limited as a consequence of the strain on the rubber parts in the actuator.

It is the aim of the present disclosure to overcome the above-listed disadvantages of an actuator for controlling a wheelset of conventional rail vehicles.

An embodiment of such an actuator comprises an axle casing for fastening to an undercarriage or to a wheelset bearing housing of the rail vehicle; a synchronized cylinder that is provided in the axle casing and that comprises a piston surface that has a piston rod passing through the axle casing at each of its two areal sides; and a housing that is movable in accordance with a movement of the synchronized cylinder with respect to the axle casing, wherein a piston spring element that connects the respective piston rod to the housing is arranged at the end of a respective piston rod remote from the piston surface.

It is accordingly possible for the actuator to cause a movement of the housing that is in turn used to cause a pivot movement of the wheelset by the adjustment of the synchronized cylinder or by the movement of the piston rods.

The axle casing is fastened to a fixed position at the undercarriage so that a relative movement of the housing with respect to the axle casing is usable for a stroke for deflecting a wheelset.

In accordance with an optional modification of the present disclosure, the axle casing has a substantially elongate shape and the synchronized cylinder is arranged at the longitudinal center of the axle casing.

Provision can be made that the two piston rods are oriented perpendicular to the longitudinal direction of the axle casing.

In accordance with a further development of the present disclosure, the piston spring element arranged at a respective piston rod is a rubber laminated spring that is of cylindrical shape and/or whose layers are stacked in parallel with the longitudinal direction of the respective piston rod. Such a rubber laminated spring is adapted to replicate or determine the longitudinal stiffness of the wheelset guide. Provision can furthermore be made that such a rubber laminated spring is installed with preloading via a bearing sleeve. Furthermore, such rubber laminated springs can have a very low shear resistance so that the wheelset bearing housing can exert movements perpendicular to the longitudinal axis of the piston without any substantial load on the piston rod and its guide. On a correctly oriented installation of an actuator in an undercarriage of a rail vehicle, it is accordingly possible to carry out a transverse movement of the wheelset without a substantial load on the piston rod, whereas a desired spring force acts in the longitudinal direction.

It is furthermore possible that the housing is either pressed into an axle guide or is directly connected, for example screwed, to a wheelset bearing housing. It can, however, furthermore also be integrated directly in the wheelset bearing housing.

In accordance with a further development of the present disclosure, the actuator comprises at least one axle casing spring element that is arranged between the axle casing and the housing. The main spring direction of the axle casing spring element is oriented in parallel with a longitudinal direction of the axle casing and the axle casing spring element is a rubber laminated spring whose layers are stacked in parallel with the longitudinal direction of the axle casing. Provision can be made here that the axle casing is rotationally symmetrical with respect to its longitudinal axis. The axle casing can also have mirror symmetry with respect to a plane that is perpendicular to the longitudinal axis of the axle casing.

In an installed state of the actuator, the axle casing spring element replicates the transverse stiffness of the wheelset guide or determines it. An axle casing spring element may be soft in a direction perpendicular to the main spring direction so that the actuator can carry out high displacements with a low power consumption.

Provision can furthermore be made here that a pair of axle casing spring elements is provided at one side of the plane defined by the piston rod and a longitudinal direction of the axle casing and is arranged such that it cushions a movement of the housing directed in the longitudinal direction of the axle casing with respect to the axle casing. In an installed state of the actuator, this corresponds to the cushioning of a transverse movement of the undercarriage with respect to the wheel set.

In accordance with a further embodiments of the present disclosure, the actuator has a sliding element for a sliding bearing of the housing at the axle casing in a plane defined by the longitudinal direction of the piston rod and a longitudinal direction of the axle casing. A first sliding element being provided at a first side of the plane defined by the longitudinal direction of the piston rod and a longitudinal direction of the axle casing and with a second sliding element being provided at the other, second side of the plane. The sliding element enables the housing to move in a longitudinal direction of the piston rod with respect to the axle casing. In an installed state of the actuator, this direction of movement corresponds to a longitudinal direction.

In accordance with an embodiment, the sliding element has a planar sliding surface to permit a movement in the longitudinal direction of the piston rod, with an element in the shape of a segment of a circle being provided to permit a rotation about a perpendicular to the plane defined by the longitudinal direction of the piston rod and the longitudinal direction of the axle casing.

It is thereby possible to obtain movements that reduce wear and with low frictional coefficients. Provision can furthermore be made that the sliding element is radially preloaded. In accordance with a version of the present disclosure, the sliding element can furthermore be designed as a rubber laminated spring in a similar manner to such a rubber laminated spring such as can also be used with the piston spring element.

The actuator furthermore comprises a position encoder that cooperates with a piston rod and the axle casing to determine the offset of the synchronized cylinder from a zero position. In accordance with a further embodiment of the present disclosure, the actuator furthermore comprises a valve that connects the two chambers of the synchronized cylinder to one another. The actuator also includes a valve control that is adapted to achieve an adjustment of the synchronized cylinder by a closing and an opening of the valve in that the flow of a hydraulic fluid from the one chamber into the other chamber is permitted in a direction corresponding to the desired adjustment movement, with the actuator not making use of or having a hydraulic unit for the active actuation of the synchronized cylinder.

The valve can, for example, be switched such that it allows a hydraulic fluid to flow from the one chamber into the other chamber. The valve may also prevent a backflow from the other chamber into the one chamber. If external forces that generate a corresponding hydraulic fluid flow then act on the piston rod, the actuator is brought into the desired position. Forces can thus be indirectly or passively generated by the synchronized cylinder.

In accordance with a further embodiment of the present disclosure, the valve of the actuator is coupled to a further synchronized cylinder of a leading or trailing actuator, with the valve control being adapted to utilize the hydraulic fluid flow of the trailing actuator as required for the adjustment of the leading actuator, with neither the trailing nor the leading actuator making use of or having a hydraulic unit for the active actuation of the synchronized cylinder. A plurality of wheelsets that are arranged trailing or leading with respect to one another are typically present in a rail vehicle. An actuator of an associated wheelset may also be coupled to a leading or trailing actuator.

In accordance with a further embodiment of the present disclosure, the actuator comprises a hydraulic unit for actuating a synchronized cylinder, with the hydraulic unit being arranged at the undercarriage and/or a the front side at a longitudinal end of the axle casing.

Provision can furthermore be made that the actuator has an energy generation unit for supplying the actuator with energy. The energy generation unit generates energy while utilizing pressure changes in the synchronized cylinder or hydraulic fluid flows that occur during travel of the rail vehicle. Provision can also be made that the energy thus generated is stored in an energy storage unit and is supplied to the actuator as required.

Since the wheelset also carries out a small continuous rocking movement in the direction of travel (so-called sine movement) when a rail vehicle travels straight ahead, an actuator connected to the wheelset experiences pressure changes in its synchronized cylinder that can be used as the energy source. A battery that takes over the power supply of the actuator and of the further optional components of the actuator such as electronics, a sensor system, valves or a hydraulic unit can be charged via a generator. The generator may utilize the pressure changes or the hydraulic fluid flows based thereon for the gaining of energy. The energy generation unit is accordingly adapted to convert pressure changes in the synchronized cylinder into electrical energy.

Alternatively or additionally, the energy generation unit can be adapted to convert a hydraulic fluid flow occurring due to pressure changes in the synchronized cylinder into electrical energy. If a valve that can connect the individual chambers of the synchronized cylinder is connected between these chambers, an energy generating pressure change can be caused by a corresponding valve actuation. Provision can furthermore be made that the energy generation unit is arranged in the actuator housing itself or centrally in an undercarriage of the rail vehicle. The same applies to the energy storage unit. The energy generation unit in particular reveals its strengths and delivers convincing results at low speeds of a rail vehicle due to the pressure changes of the synchronized cylinder.

The present disclosure further relates to an undercarriage of a rail vehicle having an actuator in accordance with one of the above-listed variants, with the axle casing of the actuator being rigidly connected to the undercarriage. The housing of the actuator may also be pressed into an axle guide, be connected to a wheelset bearing housing, or be integrated into a wheel set bearing housing.

In accordance with a further development of the undercarriage, one actuator per wheelset is provided and/or the actuator has such a high inherent damping in a non-actuated state that permits an autonomous alignment of the wheelset on traveling over a straight rail section.

The actuator may also be arranged at that side of the wheelset that is remote from a drive of the shaft of the wheelset.

The present disclosure furthermore relates to a method of operating an actuator that is adapted to control a wheelset of a rail vehicle, in particular such an actuator in accordance with one of the preceding variants, wherein, in the method, the adjustment of the actuator for pivoting the wheelset is carried out on the basis of a displacement angle of the undercarriage with respect to a car body supported by the undercarriage and the adjustment of the actuator on the basis of the displacement angle takes place after exceeding a first threshold value of the displacement angle, with the adjustment of the actuator taking place proportionally to the displacement angle.

The displacement angle of the undercarriage with respect to the car body here describes an angular offset that the undercarriage adopts with respect to the car body when the rail vehicle travels through a curve. The wheelset is controlled by the actuator in dependence on this angle of rotation after exceeding a first threshold value.

This threshold may be chosen to cooperate with the rocking motion of the wheelsets, that typically occurs on a straight ahead movement, since to not to control the actuators on the basis of a displacement angle of the undercarriage. Rather, a rigid support of the wheelset in such a state may be provided. The wheelset is controlled after exceeding the threshold value so that a control of the actuator takes place during cornering.

In accordance with a further development of the method, the actuator for pivoting the wheelset is connected to a further leading or trailing actuator of the rail vehicle, with the trailing actuator being adjusted on the basis of the adjustment movements of the leading actuator to eliminate any system-induced delays in the adjustment of the trailing actuator. An even faster adjustment of the wheelset on the tracks is thus possible overall.

Further features, details and advantages of the present disclosure will be explained with reference to the following description of the Figures.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIGS. 1-8 are shown approximately to scale.

DETAILED DESCRIPTION

Figure 1:
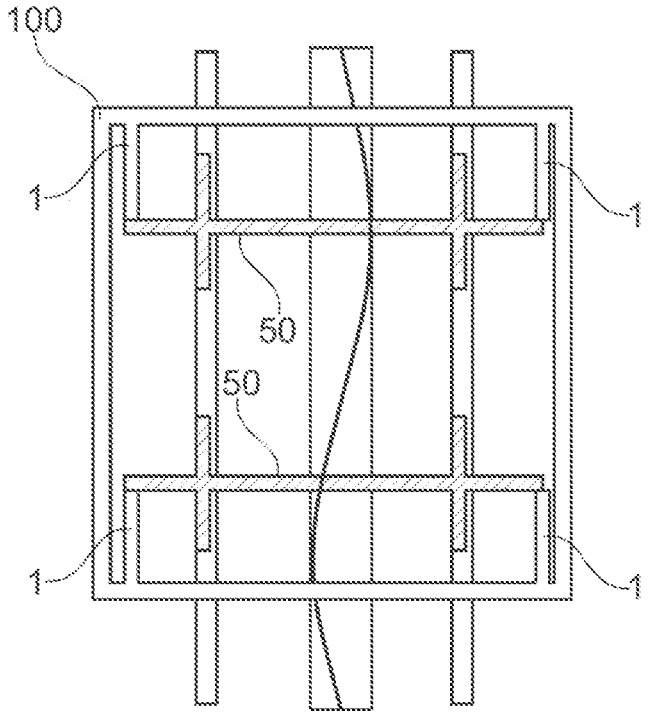
FIG. 1 shows an optimum actuator position of a wheelset when a rail vehicle travels straight ahead.

FIG. 1 shows the schematic representation of two wheelsets 50 of an undercarriage 100 that are each held by a plurality of actuators 1 when the rail vehicle travels straight ahead. The sine movement that occurs due to the conicity of the wheels of the wheelset and that is typical with a rail vehicle when traveling straight ahead is here also drawn schematically.

Figure 2:
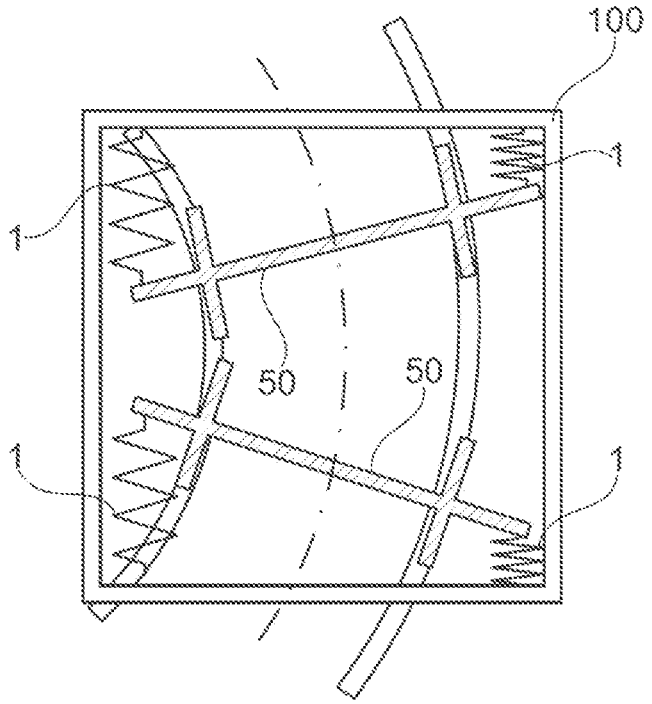
FIG. 2 shows an optimum position of an actuator during cornering.

FIG. 2 likewise shows a schematic representation during a cornering of a rail vehicle in which the actuators 1 of a wheelset 50 pivot the wheelset 50 with respect to the undercarriage 100 of a rail vehicle.

Figure 3:
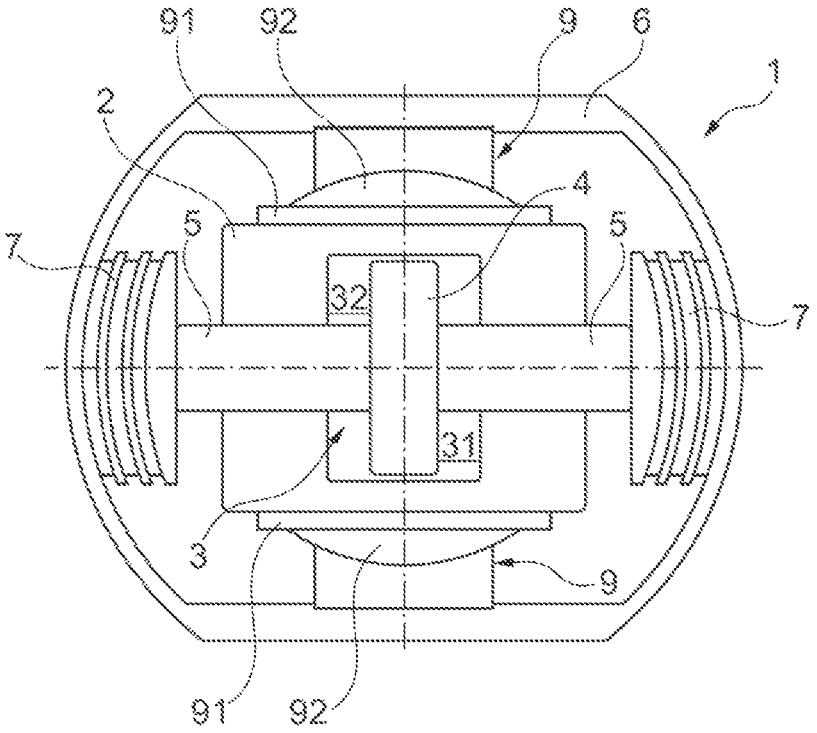
FIG. 3 shows a sectional view of an actuator whose sectional plane is the longitudinal direction and the vertical direction in an installed state.

FIG. 3 shows a sectional view of the actuator in accordance with the present disclosure in the X-Z plane installed in a rail vehicle. The X plane, shown in FIG. 3 as horizontal, corresponds to the longitudinal direction of a rail vehicle that corresponds to the forward direction on traveling straight ahead. The Z direction, shown in FIG. 3 as vertical, is the vertical direction of the rail vehicle. The Y direction is that direction moving out of the plane of the paper that is perpendicular to the X and Z directions and in so doing describes the width direction of a rail vehicle. The sectional view of FIG. 3 shows an actuator 1 that has an axle casing 2 extending in the Y direction. This axle casing 2 has a cylinder 3 that is formed in the manner of a synchronized cylinder in a middle section. It can furthermore be recognized that the axle casing 2 is formed rotationally symmetrical to its longitudinal axis. In addition, the axle casing 2 has mirror symmetry to a plane that is oriented perpendicular to its longitudinal direction.

The piston surface 4 of the cylinder 3 has a piston rod 5 that passes through the axle casing 2 at each of its two areal sides. The piston rods 5 are oriented in the X direction here. A piston rod spring element 7 that is connected to a housing 6 of the actuator 1 is arranged at the ends of the respective piston rod 5 arranged outside the axle casing 2.

The cylinder chambers 31, 32 formed in the axle casings 2 are here separated from one another by the piston surface 4 of the synchronized cylinder 3. A displacement of the cylinder 3 in the X direction, that is perpendicular to the longitudinal direction of the axle casing (Y direction), is possible with the aid of feed lines, not shown, into the cylinder chambers 31, 32 or corresponding drain lines from the cylinder chambers 31, 32. Not only the piston rod 5 and the piston rod spring element 7 arranged at a front side of the piston rod 5 are thereby displaced, but also the housing 6 connected to the piston rod spring element 7. Said housing slides over a sliding element 9 in the X direction along the axle casing 2.

In this respect, a plurality of sliding elements 9 can be provided that are arranged offset from one another in the vertical direction (Z direction). Each sliding element 9 can here have an element 92 shaped as a segment of a circle and a sliding plate 91 so that a rotation of the housing 6 about the Z axis (vertical direction) is also possible.

The piston rod spring element 7 is a rubber laminated spring in the representation that is adapted to replicate or to determine the longitudinal stiffness of the wheelset guide. It can be of cylindrical shape and is installed with a preload via a bearing sleeve. The piston spring element 7 furthermore has a low shear resistance so that the wheelset bearing housing can perform the movements about the X axis and the transverse movements without any substantial load on the piston rod 5 and its guides through the axle casing 2.

Accordingly, not only the associated piston rod 5 and the piston spring element 7 move by the movement of the synchronized cylinder 3 in the X direction, but also the housing 6 arranged at the piston spring element 7. The sliding element 9 that can be provided in the Z direction both at an upper side and at a lower side of the axle casing 2 here supports the freedom of movement of the housing in the X direction and for a rotation about the Z axis.

Figure 4:
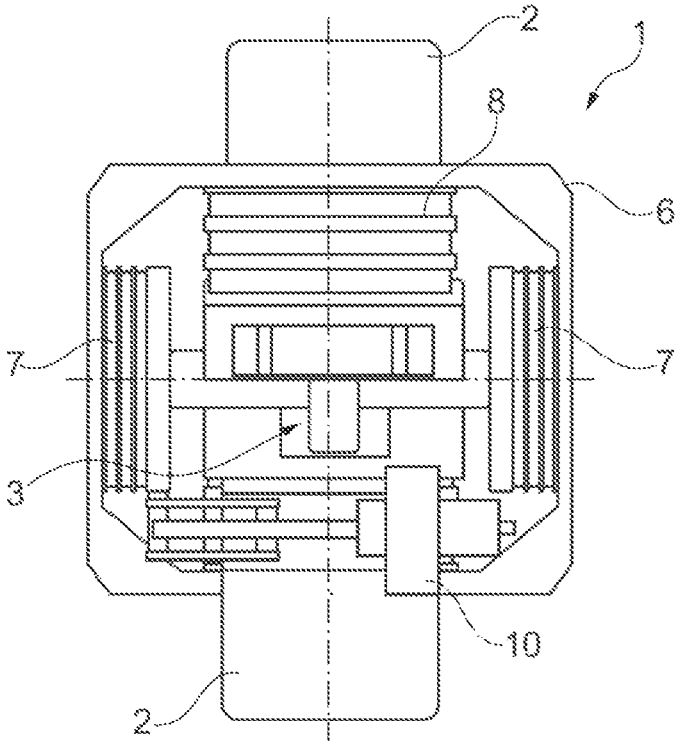
FIG. 4 shows a partial sectional view of the actuator whose sectional plane in an installed state corresponds to the longitudinal direction and the width direction.

FIG. 4 shows a partial sectional view in the X-Y plane. The X-Y plane corresponds to a plan view of the partially exposed actuator 1. The X-axis is show as horizontal in FIG. 4. The Y-axis is shown as vertical in FIG. 4.

It can be recognized that sections of the axle casing 2 that are provided for a fastening to an undercarriage frame project out of the housing 6 at both sides. The relative movement of the actuator 1 with respect to the undercarriage that is utilized for a pivoting of the wheelset with respect to the undercarriage results from the fixed linking of the axle casing 2 to an undercarriage and from the possibility of the cylinder movement with respect to the axle casing 2. The cylinder 3 and the housing 6 are here moved perpendicular to the Y axis (width direction) along the X axis (longitudinal direction). In addition to the components already named in FIG. 3, the actuator in this representation has a position encoder 10 that is adapted to detect the position of the cylinder. For this purpose, the position encoder 10 is connected at the axle casing 2 and a component connected to a piston rod 5.

An axle casing spring element 8 can furthermore be recognized that provides a cushioning between the housing 6 and the axle casing 2. The main spring direction of this axle casing spring element 8 is here in parallel with the longitudinal direction (Y direction) of the axle casing 2 and thus substantially serves the replication or determination of the transverse stiffness of the wheelset guide. The axle casing spring element 8 can here likewise be designed as a rubber laminated spring that is soft in the X direction to enable high adjustment paths with a low actuator force. The axle casing spring element 8 can here be provided pair-wise offset in the Y direction between the axle casing 2 and the housing 6. Provision can also be made that the axle casing spring elements 8 are attached pairwise at the top or at the bottom (in the Z direction). The number and the arrangements positions of the axle casing spring elements 8 are provided in dependence on the demand of the actuator.

Figure 5:
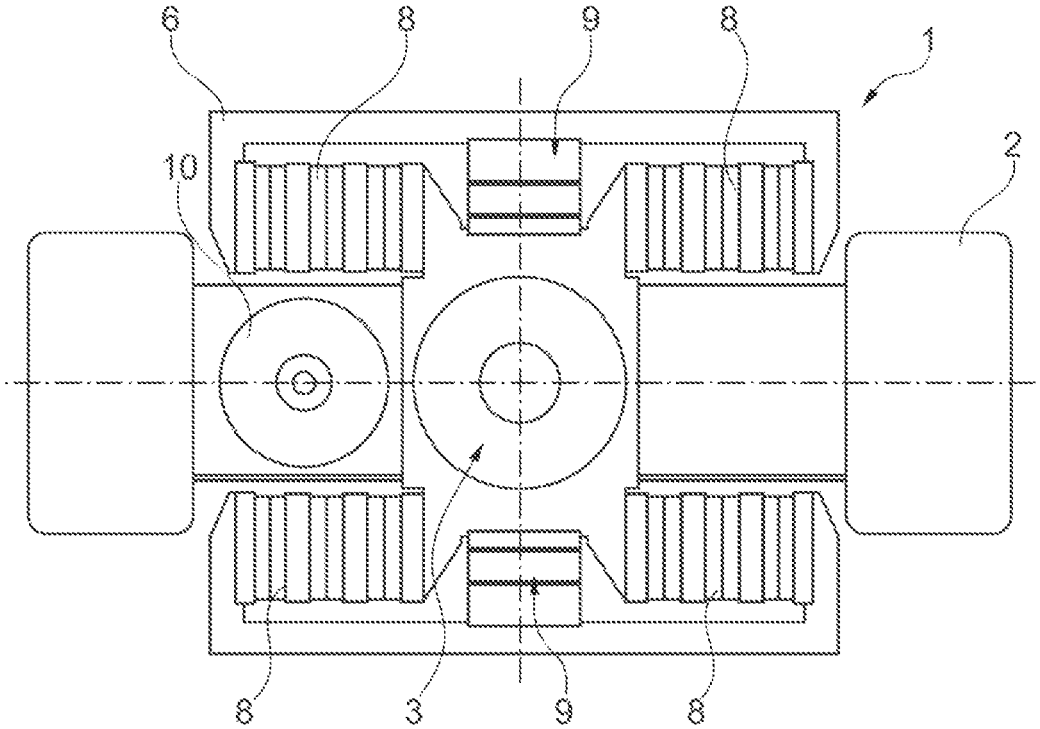
FIG. 5 shows a sectional view of the actuator whose sectional plane corresponds to the width direction and the vertical direction in an installed state of the actuator.

FIG. 5 shows a sectional view of the actuator 1 in a Y-Z plane. On an installation of the actuator 1 in a rail vehicle or in an undercarriage of a rail vehicle, this corresponds to a view from the rear or from the front. The Y-axis is shown as horizontal in FIG. 5. The Z-axis is shown as vertical in FIG. 5.

The synchronized cylinder 3 whose piston rods 5 can now be moved out of the plane of the paper or into the plane of the paper is substantially oriented perpendicular to the longitudinal direction of the axle casing 2. The axle casing 2 has a middle section that has a flange-like protrusion to form contact surfaces for the plurality of axle casing spring elements 8. The sliding elements 9 for a sliding support of the housing at the axle casing 2 are furthermore also provided at the middle section. It can be recognized in this view that the housing 6 does not have any direct linking point to the axle casing 2 so that it is displaceably supported with respect thereto. The position of the housing 6 here depends on the position of the synchronized cylinder 3 with respect to the axle casing 2. To determine the position, a position encoder 10 is provided that cooperates with a piston rod 5 of the synchronized cylinder 3 so that the current position of the housing 6 or of the piston of the cylinder 3 can be determined.

Figure 6:
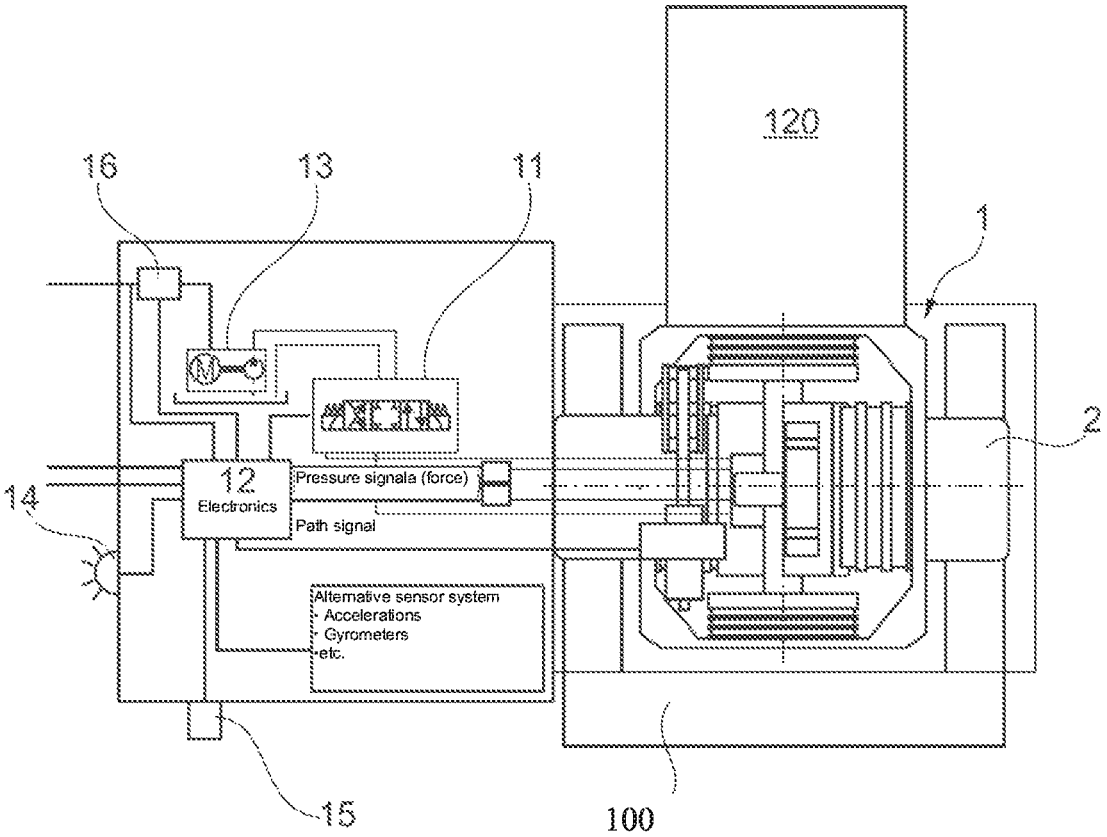
FIG. 6 shows a structural image that shows the arrangement of the actuator in an undercarriage.

FIG. 6 shows a schematic representation of the actuator that has a hydraulic unit 13 as well as a valve 11 and the associated valve control 12. The actuator 1 described in the preceding Figures can be recognized whose longitudinal ends of the axle casing 2 are in a rigid connection to an undercarriage frame 100 or undercarriage. Furthermore, the hydraulic unit 13 that is connected to the chambers 31, 32 of the cylinder 3 via hydraulic lines is here arranged at the front side at the axle casing 2. An adjustment movement of the cylinder can be carried out by the pumping of the hydraulic fluid into one of the two chambers and by the draining of hydraulic fluid from the other chamber. This has the result that the wheelset bearing housing 120 is adjusted in accordance with the adjustment movement of the cylinder. As a result, this produces a pivoting of the wheelset with respect to the undercarriage 100, which is of advantage on a cornering of a rail vehicle.

A state display is marked by reference numeral 14 that can be a color LED lamp in an embodiment. It is attached to the housing of the actuator 1 in an easily visible manner and enables a state recognition with the aid of a visual control. Provision can be made here that the recognition concept of the state is designed as follows:

When working properly the lamp 14 lights up continuously as green, with the color changing to red on a malfunction. If a differentiated diagnosis should be able to be displayed, further colors such as orange, yellow, etc. can be used or a non-lighting up can be used as a further status. A power failure, a sensor failure, a pump line can be considered as examples for further status.

A wirelessly working diagnosis stick 15 can furthermore also cooperate with an actuator 1. As a USB dongle having WiFi data transmission, it can transmit information to a mobile end device 93. It is advantageous that this can also take place during a trip of the rail vehicle so that the measurement parameters of the respective undercarriage can be recorded over a known distance and can be compared with corresponding data of a correctly operating system. It is of advantage if the transmission of the data takes place to the respective car or another car of the rail vehicle or to the driver's cab. All the data of the system that are present such as sensor data, valve data, data on the motor and on the pump, the power supply and a status display can be recorded here. The system data can then be recorded over the time or over the distance with the aid of diagnostic software and can be compared with measurement data of the same distance or of the same path section saved earlier. It is possible to recognize required corrective interventions and to plan them at an early time with the aid of this interface.

It can be recognized that an energy supply 16 is connected to the hydraulic unit 13 and to the valve control 12 to supply these units with energy.

Figure 7:
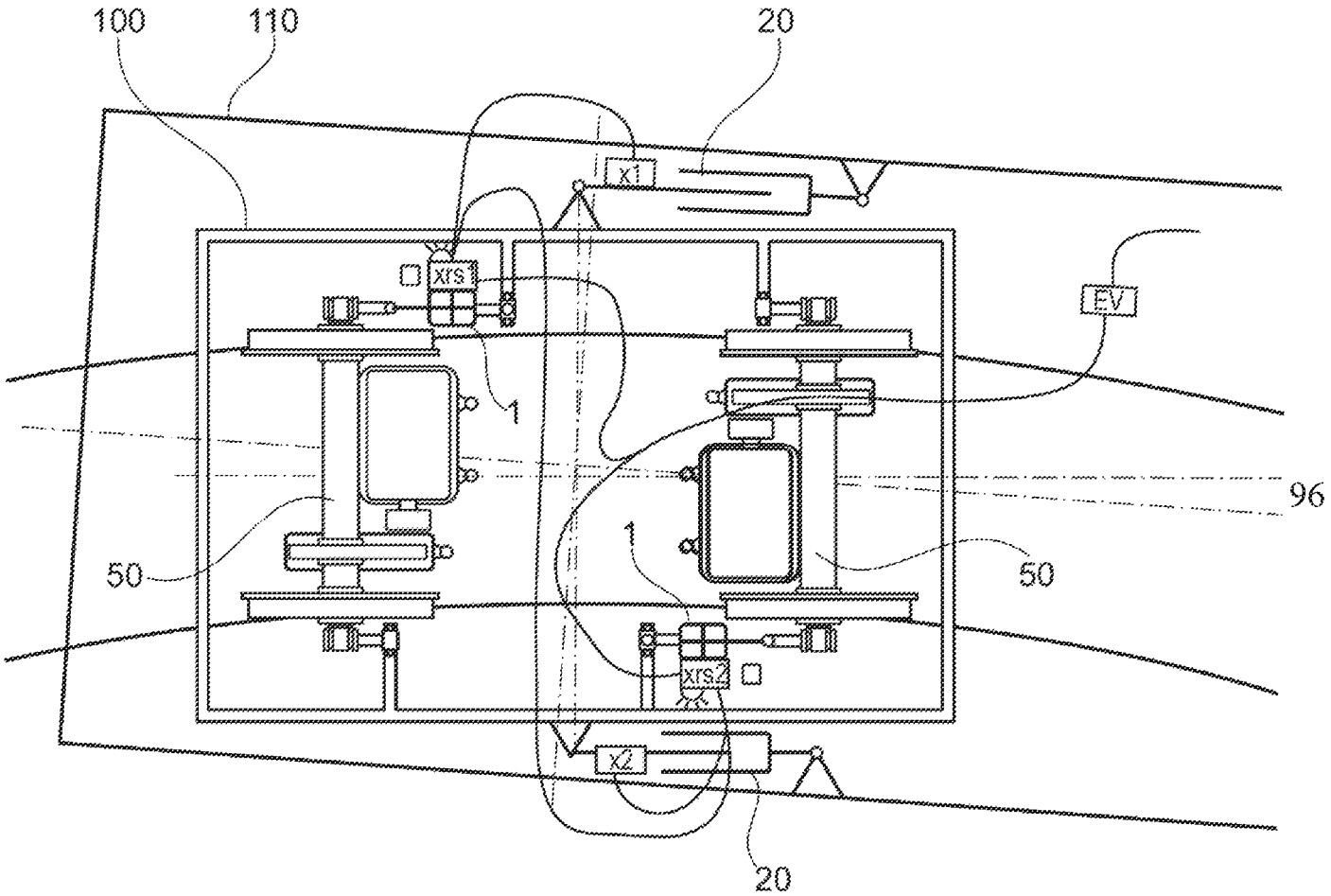
FIG. 7 shows a structural drawing that shows the arrangement of an actuator in an undercarriage of a rail vehicle.

FIG. 7 shows a schematic representation of the actuator 1 in an installed state of a rail vehicle. The undercarriage 100 of the rail vehicle is here supported movably with respect to the car body 110 of the rail vehicle. When traveling a curve, the undercarriage 100 will accordingly move into the curve, whereas the longer car body is rotated with respect to the undercarriage. This angle, that is called the displacement angle 96, is determined with the aid of a measurement apparatus 20 and is forwarded to the actuator 1 or to the plurality of actuators 1. The wheelsets of an undercarriage 100 are pivoted with respect to the undercarriage 100 on the basis of the displacement angle that is determined with the aid of the measurement device 20.

The arc radius of a curve travel is accordingly determined with the aid of the measurement apparatus 20 that is, for example, provided by position encoders lengthways in or at the anti-rolling device or also separately therefrom.

The control of the wheelsets 50 then takes place via the electrohydraulic actuator 1, with a respective one actuator 1 being provided per wheelset 50. They may be arranged with point symmetry with respect to one another, with the actuator 1 being arranged at the end remote from the drive of the shaft of the wheelset 50. With one actuator 1 per wheelset 50, the former has to exert larger adjustment distances, but the number of components and the costs associated therewith drop considerably. Such an arrangement furthermore provides the advantage that the wheelset 50 is unambiguously positioned in the longitudinal direction and considerably smaller movements arise on the coupling with driven wheelsets.

The actuator 1 may also have a high inherent damping in the passive or non-actuated state since then the wheelset 50 can autonomously align itself ideally when traveling straight ahead and the effectively active longitudinal stiffness of the wheelset guide remains high and ensures a stable handling.

Figure 8:
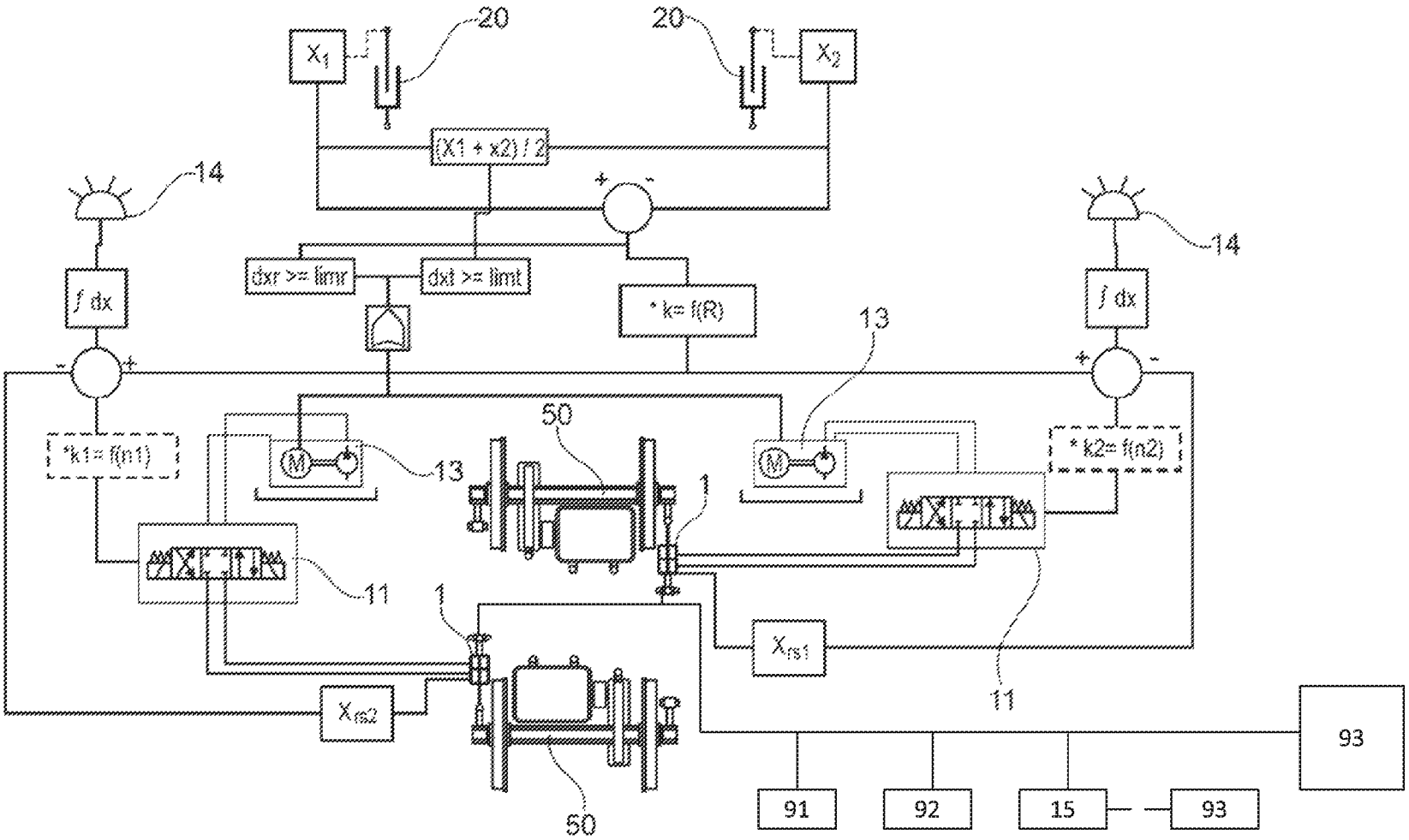
FIG. 8 shows a functional drawing for representing the mode of operation of the actuator.

FIG. 8 shows the control concept in accordance with a basic design. The measurement of the displacement angle that determines the angular offset of a car body 110 with respect to an undercarriage 100 takes place via the measurement apparatus 20 here. The control of the actuator 1 then takes place on the basis of the displacement angle. This takes place after exceeding a threshold value so that less impairment of the stable handling occurs by the control as a consequence of a sine movement or of a car body movement. Provision can be made in this respect that the control of the actuator 1 takes place proportionally to the displacement angle, which is also to the arc radius of the curve. However, this is after exceeding the already previously mentioned threshold value.

The actuation of the actuator 1 may take place via a 4/3 way valve 11 that is actuated accordingly via the difference between the desired path and the actual path.

Provision can be made in accordance with the present disclosure here that the control also makes use of further criteria in further cases. Possible further criteria are given in the following in a list:

- radii, dependently degressive, progressive, step-wise, with any desired transfer functions being conceivable;
- travel speed or transverse acceleration;
- traction force that is determined by the measurement of the longitudinal movement between the car body 110 and the undercarriage 100;
- the actuator force itself that is determined by a pressure measurement in the actuator 1, with this taking account of the quality of the contact geometry between the wheel and the rail;
- an individual control of the wheelsets, leading or trailing; and
- a control in the higher frequency range to stabilize the undercarriage (practically at level phase to the sine movement) so that the use of an anti-rolling device can be dispensed with.

Provision can furthermore be made that the hydraulic unit 13 that comprises pumps and a motor is activated as needed. On exceeding a second threshold value of the desired/actual position difference, the pump can be activated and the energy consumption of the actuator can thus be considerably reduced. This means that the pump may be switched on with track conditions having a poor contact geometry, whereas the wheelset 50 brings itself into the correct position without additional force with an acceptable contact geometry since this is also possible with passively activated valves without making use of the hydraulic unit 13.

Provision can furthermore be made that the actuator systems of two or more undercarriages 100 are connected to utilize the information of a leading undercarriage 100. It is thus possible to eliminate delays of the system on the start-up of the pumps of the hydraulic unit for the trailing undercarriages and to exit them in good time. It is thereby also possible to optimize control methods for a running through transitional curves or for track switches.

In an embodiment, the actuator is controlled autonomously from each undercarriage. An energy supply is provided, whereas the data detection, data processing and the actuation itself take place within an undercarriage.

The actuator 1 in the wheelset guide is here integrated in an axle guide bearing or a support bearing. A motor, a pump (both at reference numerals 13), valves 11, path sensors and pressure sensors 91, and a control unit 92 are provided to control the actuator 1 in FIG. 8. It is not precluded that further sensors are present that are required for control methods at a higher ranking. Accelerometers or gyrometers can be considered here, for example. One embodiment may not include external hydraulic lines, whereby the risk of a leak and of a failure is reduced.

The control of the actuator 1 is additionally failsafe in design since the system acts as a stiff wheelset guide with high inherent damping on a failure of the electronics, the sensor system, the power supply, the pump and/or the motor. This means that the undercarriage acts like a classical undercarriage without a wheel set control or with a very slowly acting control.

On a leak and the loss of the longitudinal stiffness, a bumpy running of the undercarriage is adopted that can result in unstable running. The residual damping and residual stiffness in the system, however, prevent an exceeding of safety-relevant limit values of the wheel-rail forces.

Provision can furthermore be made in accordance with an embodiment of the present disclosure that the energy supply is autonomous. An energy generation unit is provided for this purpose that generates its energy using the pressure changes in the synchronized cylinder. For example, a hydraulic fluid pressed out of the cylinder can also be used here to generate energy. The pressures in the cylinder also change continuously while traveling straight ahead so that a passively connected actuator can also be used as the energy source. The power supply of the electronics, of the sensor system, of the valves, and also of the pump can be provided with this energy. The energy generation can here be maximized by a direct actuation of the valves in different travel states.

One embodiment of actuator 1 incorporates such an autonomous energy supply. This concept can also be used when a particularly low energy control state is desired and is not restricted to an autonomous energy supply.

In this respect, each actuator 1 is individually actuated in that the valves each permit the oil flow in the desired direction toward a position of the actuator to be adopted. If the contact geometry between the wheel and the track is sufficient, a wheelset can also be ideally adopted due to this control. If the quality of the contact geometry is, however, not sufficient to reach an autonomous adjustment of the actuator into the desired position, the two cylinders of the leading and trailing wheelsets may be coupled mutually via hydraulic lines and additional valves so that the flow of the hydraulic fluid of the trailing wheelset can be used as required to control the leading wheel set.

This embodiment is in particular of interest in the retrofitting of older vehicles that do not permit the installation of an energy supply due to a lack of available space. The controllable actuator thus does not have any hydraulic unit that comprises a motor and pump, but rather valves between the individual chambers of the synchronized cylinder. It is thus possible to have the cylinders generate forces indirectly or passively. This is done, for example, by opening a valve so that a flow between the chambers is permitted when a force is transferred by the rail to the wheelset that effects an actuation of the actuator in the desired direction. The control of the valves can here likewise take place in accordance with different criteria. They can, for example, be the arc radius of a rail curve, traction force, the radial position of the two wheelsets and/or the cylinder force. It is thus of advantage, for example, to block the throughflow of a hydraulic fluid of the cylinder in both directions to prevent an off-center vehicle running.

Provision can also be made that the cylinder chambers of the leading and trailing actuators are coupled to the mutual control via hydraulic lines. It is thus possible that the leading wheelset is controlled via the movement of the trailing wheelset.

A particularly inexpensive variant of an embodiment in accordance with the present disclosure provides that the actuator does not have a position encoder, but rather a measurement device 20 for determining the displacement angle or the arc radius. A central unit furthermore has electronics, the valves, the generators, an energy store, and a status display. Hydraulic lines also run from the cylinders to the central unit that is in turn connected via a cable connection to the measurement device for determining the displacement angle or the arc radius.

A further function that results on the basis of the actuator in accordance with the present disclosure is the carrying out of a track diagnosis. The present disclosure makes a diagnosis of the track or rail state possible with relatively little effort due to its concept. The information on the arc radius and on the individual position of the wheelsets are available from the concept of the present disclosure. If the system is added to by pressure sensors and a transverse acceleration sensor, all the parameters of interest that describe the track state can be derived. The individual parameters are here determined as shown using the following table 1.

TABLE 1

Derivation of the parameters defining the track state

| Parameter | Measurement values/Vehicle parameters |
|---|---|
| Arc radius | Displacement angle undercarriage 1: Ψ 1 Displacement angle undercarriage 2: Ψ 2 Center pin spacing |
| Start-up angle: αi | Displacement angle undercarriage 1: Ψ1 Displacement angle undercarriage 2: Ψ2 Angle of rotation of wheelset i: Ψrsi |
| Track displacement force: ΣYi | Actuator force wheelset 1: Fact1<br>Actuator force wheelset 2: Fact2<br>Non-compensated transverse acceleration: aq Wheel load<br>Stiffness of the wheelset guide<br>Wheel base<br>Displacement stiffness of the secondary cushioning |
| Single wheel force, transverse: Yij | Track displacement force<br>Start angle |
| Wear factor | Single wheel force, transverse: Yij<br>Start-up angle: αi |
| Rolling radii difference | Arc radius<br>Actuator force wheelset 1: Fact1<br>Actuator force wheelset 2: Fact2<br>Wheel load |
| Conicity | Actuator force wheelset 1: Fact1 (dynamic) Actuator force wheelset 2: Fact2 (dynamic) |
| Track twisting | Path sensors, vertical |
| Track position disturbances, transverse | Acceleration sensors, transverse (dynamic) |
| Track position disturbances, vertical | Acceleration sensors, vertical (dynamic) |
| Spinning vibrations | Accelerations sensors, vertical (dynamic)<br>Acceleration sensors, lengthways (dynamic) |

The diagnosis should be provided in around two to three cars of a rail vehicle. It is of aid in this connection if there is a constant connection of the actuators to a processor in the corresponding car or train with access to an evaluation system of the track diagnosis.

FIGS. 1-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An actuator for controlling a wheelset of a rail vehicle comprising:

an axle casing for fastening to an undercarriage or to a wheelset bearing housing of the rail vehicle;

a synchronized cylinder that is provided in the axle casing and that comprises a piston surface that has a piston rod passing through the axle casing at each of its two areal sides; and a housing that is movable in accordance with a movement of the synchronized cylinder with respect to the axle casing, wherein a piston spring element that connects a respective piston rod to the housing is arranged at the end of the respective piston rod remote from the piston surface, and wherein the piston spring element arranged at the respective piston rod is a rubber laminated spring that is of rectangular or cylindrical shape and/or whose layers are stacked in parallel with the longitudinal direction of the respective piston rod.

2. The actuator in accordance with claim 1, wherein the axle casing has a substantially elongate shape and the synchronized cylinder is arranged at the longitudinal center of the axle casing.

3. The actuator in accordance with claim 2, wherein the two piston rods are oriented perpendicular to the longitudinal direction of the axle casing.

4. The actuator in accordance with claim 1, further comprising an axle casing spring element that is arranged directly between the axle casing and the housing, wherein a main spring direction of the axle casing spring element is oriented in parallel with a longitudinal direction of the axle casing; and wherein the axle casing spring elements are rubber laminated springs whose layers are stacked in parallel with the longitudinal direction of the axle casing.

5. The actuator in accordance with claim 4, wherein a pair of axle casing spring elements is provided at one side of the plane defined by the longitudinal direction of the piston rod and by a longitudinal direction of the axle casing and is arranged such that it cushions a movement of the housing directed in the longitudinal direction of the axle casing with respect to the axle casing.

6. The actuator in accordance with claim 1, further comprising a sliding element for the sliding support of the housing at the axle casing in a plane defined by the piston rod and by a longitudinal direction of the axle casing, wherein a first sliding element is provided at a first side of the plane defined by the piston rod and by a longitudinal direction of the axle casing and a second sliding element is provided at a second side.

7. The actuator in accordance with claim 6, wherein the sliding element has a planar sliding surface to permit a movement in the longitudinal direction of the piston rod and has an element in the shape of a segment of a circle to permit a rotation about the normal direction with respect to the plane defined by the longitudinal direction of the piston rod and by a longitudinal direction of the axle casing.

8. The actuator in accordance with claim 1, further comprising a path sensor that cooperates with a piston rod and the axle casing to determine the offset of the synchronized cylinder from a zero position.

9. The actuator in accordance with claim 1, further comprising a valve that connects the two chambers of the synchronized cylinder to one another and a valve control that is adapted to achieve an adjustment of the synchronized cylinder in that the flow of a hydraulic fluid from the one chamber into the other chamber is permitted in a direction corresponding to the desired adjustment movement, with the actuator not making use of or having a hydraulic unit for an active actuation of the synchronized cylinder.

10. The actuator in accordance with claim 9, wherein the valve of the actuator is coupled to a further synchronized cylinder of a leading or trailing actuator; wherein the valve control is adapted to utilize the hydraulic fluid flow of the trailing actuator for the adjustment of the leading actuator; and wherein neither the trailing nor the leading actuator makes use of or has a hydraulic unit for an active actuation of the synchronized cylinder.

11. The actuator in accordance with claim 1, further comprising a hydraulic unit for actuating the synchronized cylinder, wherein the former is arranged at the undercarriage and/or at the front side at a longitudinal end of the axle casing.

12. The actuator in accordance with claim 1, further comprising an energy generation unit for supplying the actuator with energy that generates an energy while utilizing pressure changes in the synchronized cylinder or hydraulic fluid flows of the synchronized cylinder based thereon that occur on a travel of the rail vehicle.

13. The actuator in accordance with claim 1, further comprising sensors that enable a higher quality control and/or diagnosis of the undercarriage and/or of the track state.

14. The actuator in accordance with claim 1, further comprising a visual status display that can display the different status.

15. The actuator in accordance with claim 1, further comprising an interface, USB or WiFi, that can communicate with a mobile device and enables an online diagnosis.

16. The undercarriage of a rail vehicle having an actuator in accordance with claim 1, wherein the axle casing of the actuator is rigidly connected to the undercarriage; and the housing of the actuator is pressed into an axle guide, is connected to a wheelset bearing housing, or is integrated in a wheelset bearing housing.

17. The undercarriage in accordance with claim 16, wherein one actuator is provided per wheelset; and/or wherein the actuator has a high inherent damping in a non-actuated state that enables an autonomous alignment of the wheelset while traveling on a straight rail stretch.

18. The method of operating an actuator that is adapted to control a wheelset of a rail vehicle, in particular to operate such an actuator in accordance with claim 1, wherein, in the method:

the adjustment of the actuator is carried out for pivoting the wheelset with respect to an undercarriage on the basis of a displacement angle of the undercarriage with respect to a car body supported by the undercarriage; and the adjustment of the actuator based on the displacement angle takes place after exceeding a first threshold value of the displacement angle, wherein the adjustment of the actuator takes place proportionally to the displacement angle.

19. The method in accordance with claim 18, wherein the actuator for pivoting the wheelset is connected to a further leading or trailing actuator of the rail vehicle; and wherein the trailing actuator is adjusted on the basis of the adjustment movements of the leading actuator to eliminate system-induced delays in the adjustment of the trailing actuator.

* * * * *